US009373255B2

(12) United States Patent
Strauβ et al.

(10) Patent No.: US 9,373,255 B2
(45) Date of Patent: Jun. 21, 2016

(54) METHOD AND SYSTEM FOR PRODUCING AN UP-TO-DATE SITUATION DEPICTION

(71) Applicant: Continental Teves AG & Co. oHG, Frankfurt (DE)

(72) Inventors: Matthias Strauβ, Pfungstadt (DE); Ulrich Stählin, Eschborn (DE)

(73) Assignee: Continental Teves AG & Co. oHG, Frankfurt (DE)

( * ) Notice: Subject to any disclaimer, the term of this patent is extended or adjusted under 35 U.S.C. 154(b) by 0 days.

(21) Appl. No.: 14/400,868

(22) PCT Filed: May 6, 2013

(86) PCT No.: PCT/EP2013/059397

§ 371 (c)(1),
(2) Date: Nov. 13, 2014

(87) PCT Pub. No.: WO2013/171088

PCT Pub. Date: Nov. 21, 2013

(65) Prior Publication Data

US 2015/0127249 A1 May 7, 2015

(30) Foreign Application Priority Data

May 16, 2012 (DE) ..... 10 2012 208 254

(51) Int. Cl.
*G08G 1/01* (2006.01)
*G08G 1/0967* (2006.01)

(52) U.S. Cl.
CPC ..... *G08G 1/0112* (2013.01); *G08G 1/096741* (2013.01); *G08G 1/096775* (2013.01)

(58) Field of Classification Search
CPC ..... G08G 1/0112; G08G 1/096775; G08G 1/096741
See application file for complete search history.

(56) References Cited

U.S. PATENT DOCUMENTS 5,173,691 A 12/1992 Sumner
6,178,374 B1 1/2001 Mohlenkamp (Continued)

FOREIGN PATENT DOCUMENTS

DE 19513640 6/1996
DE 19643454 4/1998

(Continued)

OTHER PUBLICATIONS

International Search Report for International Application No. PCT/EP2013/059397 mailed Aug. 20, 2013.

(Continued)

*Primary Examiner* — Rodney Butler
(74) *Attorney, Agent, or Firm* — RatnerPrestia

(57) ABSTRACT

The invention relates to a method for creating a current situation depiction, particularly a current city-center situation depiction, in which environment data and/or map data and/or position data describing a locally bounded situation are sent to a database by a multiplicity of vehicles using vehicle-to-X communication means. The environment data are captured by means of ambient sensors and/or vehicle sensors, the map data are read from a digital memory, and the position data are determined at least by means of a global satellite position system. The method is distinguished in that the environment data and/or the map data and/or the position data are continually merged with a situation depiction that is already present in the database to form a current situation depiction, and both the database and the situation depiction are fixed in location. The invention also relates to an appropriate system.

12 Claims, 4 Drawing Sheets

(56) References Cited

U.S. PATENT DOCUMENTS

| | | | | |
|---|---|---|---|---|
| 8,019,535 | B2 * | 9/2011 | Endo et al. | 701/450 |
| 8,179,281 | B2 | 5/2012 | Strauss | |
| 8,354,942 | B2 | 1/2013 | Stahlin | |
| 8,401,758 | B2 | 3/2013 | Stahlin | |
| 8,781,733 | B2 | 7/2014 | Staehlin | |
| 2002/0094825 | A1 * | 7/2002 | Endo et al. | 455/456 |
| 2002/0183929 | A1 * | 12/2002 | Tsuji | G08G 1/166 701/301 |
| 2006/0091654 | A1 * | 5/2006 | De Mersseman et al. | 280/735 |
| 2007/0285305 | A1 * | 12/2007 | Tanaka | G01S 17/936 342/70 |
| 2009/0138190 | A1 | 5/2009 | Kulik | |
| 2009/0228204 | A1 * | 9/2009 | Zavoli et al. | 701/208 |
| 2011/0015853 | A1 * | 1/2011 | DeKock et al. | 701/200 |
| 2011/0196600 | A1 * | 8/2011 | Henderson | G01C 22/00 701/123 |
| 2012/0150385 | A1 * | 6/2012 | Paquette et al. | 701/33.4 |
| 2012/0176267 | A1 * | 7/2012 | Nanami | 342/107 |
| 2013/0181823 | A1 | 7/2013 | Stahlin | |
| 2013/0245941 | A1 * | 9/2013 | Stahlin | G01C 21/28 701/532 |
| 2013/0289824 | A1 * | 10/2013 | Mudalige et al. | 701/41 |
| 2014/0210644 | A1 * | 7/2014 | Breed | 340/905 |
| 2015/0032290 | A1 * | 1/2015 | Kitahama et al. | 701/1 |
| 2015/0092056 | A1 * | 4/2015 | Rau et al. | 348/148 |

FOREIGN PATENT DOCUMENTS

| | | |
|---|---|---|
| DE | 102006010572 | 9/2007 |
| DE | 102007048809 | 7/2008 |
| DE | 102008012660 | 12/2008 |
| DE | 102008060869 | 6/2009 |
| DE | 102009008959 | 9/2009 |
| DE | 102010040803 | 3/2012 |
| EP | 1321742 | 6/2003 |
| EP | 1921588 | 5/2008 |
| WO | 0208695 | 1/2002 |

OTHER PUBLICATIONS

German Search Report corresponding to German Application No. 10 2012 208 254.9 mailed Apr. 11, 2013.

* cited by examiner

METHOD AND SYSTEM FOR PRODUCING AN UP-TO-DATE SITUATION DEPICTION

CROSS REFERENCE TO RELATED APPLICATIONS

This application is the U.S. National Phase Application of PCT International Application No. PCT/EP2013/059397, filed May 6, 2013, which claims priority to German Patent Application No. 10 2012 208 254.9, filed May 16, 2012, the contents of such applications being incorporated by reference herein.

FIELD OF THE INVENTION

The invention relates to a method for producing an up-to-date situation depiction and to a system for producing an up-to-date situation depiction.

BACKGROUND OF THE INVENTION

The prior art discloses different kinds of driver assistance systems that have the essential common feature that they serve to relieve the driver of duties pertaining to events on the road. In this case, such systems are based to some extent on environment information captured by means of ambient sensor systems, on information read from digital map material or else on information that has been received by means of vehicle-to-X communication. In order to assist the driver, all of these systems rely on the captured information being highly reliable and up-to-date and also on the density of information being as high as possible.

In this connection, DE 10 2008 060 869 A1, which is incorporated by reference, describes a method and an apparatus for assisting a user of a vehicle that is approaching a traffic signal system. The traffic signal system has two different operating states, wherein a first operating state allows the stop line to be crossed and a second operating state does not allow the stop line to be crossed. In this case, the vehicle receives a signal that describes the current operating state of the traffic signal system and also the length of time before the operating state changes. Using the received signal, the vehicle checks whether the stop line of the traffic signal system can be reached at a speed from a prescribed speed range while the traffic signal system is in the first operating state. On the basis of the result of the check, the speed of the vehicle is influenced or the driver is provided with a recommendation for appropriate influencing of the speed.

DE 10 2007 048 809 A1, which is incorporated by reference, discloses a method for recognizing concealed objects in road traffic. In this case, the surroundings of a vehicle and motion variables for the vehicle are captured by sensor. This information is transmitted by means of vehicle-to-vehicle communication to vehicles that are in the environment. At the same time, the vehicles that are in the environment likewise capture and send surroundings and motion information. The received information is used to expand an environment model. The environment model expanded in this way is reproduced in updated form by means of a display in the vehicle and can be made available to one or more driver assistance systems. Hence, the vehicle has information available about objects that cannot be sensed by the vehicle sensors themselves.

DE 10 2009 008 959 A1, which is incorporated by reference, describes a vehicle system for navigation and/or driver assistance. The vehicle system comprises a provider unit, at least one ambient sensor and a vehicle sensor. The provider unit for its part comprises a position module, based on a satellite signal sensor, and an ADAS Horizon provider, which can be communicatively coupled to a navigation unit, which may also be situated outside the vehicle. In this case, the navigation unit may be in the form of a powerful server, for example, that transmits map details from a digital map to the provider unit.

DE 10 2008 012 660 A1, which is incorporated by reference, discloses a method for the server-based warning of vehicles about hazards and also an appropriate hazard warning unit. In this case, a measured value is captured by means of a sensor unit of a first vehicle and it is determined whether the measured value corresponds to a hazard. If the measured value does correspond to a hazard, information data about the hazard are transmitted to a control center. In the control center, the type of hazard, the location at which the measured value was captured, the time at which the measured value is captured and an identification for the transmitting vehicle are stored and appropriate warning data are produced. The warning data that are relevant to a second vehicle can be retrieved from the control center by this second vehicle.

SUMMARY OF THE INVENTION

The methods and systems known in the prior art have disadvantages, however, insofar as that the information made available to a driver assistance system by means of vehicle-to-X communication is either limited to a single particular aspect of events on the road, as is the case with traffic light assistants or hazard warnings, for example, or else cannot provide the information that is needed in complex city traffic in sufficiently reliable and up-to-date form therefore, which means that such assistance systems have adequate reliability only in non-urban areas. Particularly in junction regions, it is necessary to observe a large number of different traffic rules and at the same time to recognize the desire of the driver to be able to effectively relieve the driver of duties. An important prerequisite for this, however, is the presence of both constantly up-to-date and exact information, for example about road works, diversions or altered signage. It is therefore necessary for this information to be captured continuously and in detail and also updated.

An aspect of the present invention is a method that both produces an up-to-date situation depiction having a comparatively great depth of detail and has a high update rate.

According to one aspect the method for producing an up-to-date situation depiction, particularly an up-to-date urban situation depiction, environment data and/or map data and/or position data describing a locally bounded situation are sent to a database by a multiplicity of vehicles by means of vehicle-to-X communication means. In this case, the environment data are captured by means of ambient sensors and/or vehicle sensors, the map data are read from a digital memory and the position data are determined at least by means of a global satellite position system. The method is distinguished in that the environment data and/or the map data and/or the position data are continually merged with a situation depiction that is already existent in the database to form an up-to-date situation depiction and both the database and the situation depiction are in a fixed location. This results in the advantage that any vehicle finding itself in the situation and equipped with suitable sensors can update and augment the situation depiction that is existent in the database. This means that, particularly in urban areas, there is constantly a comparatively large number of environment data and/or map data and/or position data available that have been sent by the multiplicity of vehicles, in order to update or augment the existent situation depiction. As a result, even complex and comparatively frequently changing situations can be reliably described. Additional installation complexity for the infrastructure in terms of suitable sensors for situation capture is not necessary in this case. The situation depiction produced in this manner may comprise road profiles, rules for priority in traffic, turn-off lanes, pedestrian crossings, traffic light positions, road works and broken down vehicles or other obstacles, inter alia. Even if there are meanwhile no vehicles in the situation depiction and hence meanwhile no environment data and/or map data and/or position data are sent to the database, fresh arrival of vehicles in a situation depiction can prompt the existent situation depiction to be merged without delay with the environment data and/or map data and/or position data that are then received, since both the situation depiction and the database are in a fixed location and are not lost or erased. This is an essential advantage over methods known from the prior art in which the databases are situated in the individual vehicles and the situation depictions therefore have to be constantly produced or rejected afresh, since the vehicle is always advancing and entering new situation depictions during the journey.

According to an aspect of the invention, the environment data describe the environment sensed by the vehicle, for example signage, traffic light posts, guardrails, house walls, curbstones and generally all objects that contribute to the topology of the vehicle environment, sensed by means of a suitable sensor. Even potholes sensed by means of ESP sensor systems are understood as environment data within the context of the invention. The objects covered by the environment data furthermore include other vehicles and road users if they are sensed by sensor. The term "environment data" therefore describes both information about static objects and information about nonstatic objects. By contrast, the map data describe a local map that is existent in the vehicle and are able both to comprise route information and road profile information and to be augmented by environment data. The position data indicate the position of the vehicle sending the data and are likewise depicted in the up-to-date situation depiction. The determination of the position data by the vehicles is effected by means of a global satellite position system, such as GPS or Galileo, and is preferably augmented by map matching or compound navigation.

Preferably, there is provision for the database to send the up-to-date situation depiction to the vehicles covered by the locally bounded situation and for the up-to-date situation depiction to be made available to at least one driver assistance system by the vehicles. Therefore, all the vehicles covered by the local situation have a comparatively up-to-date and detailed situation depiction available that can be used by the existent driver assistance systems to assist and relieve the driver and possibly to prevent accidents or at least to moderate accidents. By way of example, a warning can be output to the driver, or even intervention can be taken in the vehicle control, on the basis of the situation. Furthermore, improved position determination can be performed by comparing a map that is existent in the vehicle with the received up-to-date situation depiction.

In a further preferred embodiment, provision is made for objects and events in the up-to-date situation depiction to be provided with probabilities of existence by the database. This results in the advantage that comparatively fine grading in respect of the actual existence and hence the significance of the objects and events becomes possible. The probabilities of existence of the objects and events can be determined from the proportion of sensors sensing them to the proportion of sensors not sensing them, for example, with sensors that are not suited to sensing the respective objects or events being ignored for the determination of the probabilities of existence. This also allows a plurality of, in principle, inconsistent objects or events with different probabilities of existence to be depicted at the same position.

Expediently, provision is made for the probabilities of existence of the objects to be additionally individually evaluated by a receiving vehicle. Hence, a vehicle receiving the up-to-date situation depiction can use its own onboard sensor system to decide what probability of existence is meant to be attributed to an object or an event. By way of example, the received information can be used to lower the recognition thresholds of particular objects or events in an object or event recognition algorithm of the onboard sensor system.

Furthermore, it is advantageous that the environment data and/or the map data and/or the position data are sent to the database by the multiplicity of vehicles with comparatively low transmission priority. Hence, the sending and receiving of comparatively important data, such as what are known as "Cooperative Awareness Messages" or warning information, is not disturbed or even interrupted. To produce the up-to-date situation depiction, it is sufficient if the environment data and/or map data and/or position data are not sent to the database in every transmission cycle.

Preferably, provision is made for the multiplicity of vehicles to send to the database only such environment data and/or map data and/or position data as are different than the up-to-date situation depiction sent by the database. This usually significantly reduces the volume of data to be transmitted, and the transmission capacity of the available transmission channels is not unnecessarily burdened.

Expediently, provision is made for the position data sent by the multiplicity of vehicles to comprise a piece of identification information for the satellites used for determining the position data. These satellites usually follow fixed paths in an orbit of the earth. Since the satellites are therefore visible from particular points on the earth's surface only at particular times of day, the identification information can be used to ascertain which satellites have been used to determine a particular set of position data. This allows improved position determination, particularly improved relative position determination between two or more vehicles.

An aspect of the invention furthermore relates to a system for producing an up-to-date situation depiction, particularly an up-to-date urban situation depiction. The system comprises a database having data merging means and vehicle-to-X communication means and comprises a multiplicity of vehicles, each having a digital memory and/or ambient sensors and/or vehicle sensors and/or position determination means and vehicle-to-X communication means. The database receives environment data and/or map data and/or position data describing a locally bounded situation from the multiplicity of vehicles by means of the vehicle-to-X communication means. The multiplicity of vehicles capture the environment data by means of the ambient sensors and/or vehicle sensors, read the map data from the respective one digital memory and determine the position data at least by means of the global satellite position system. The system is distinguished in that the data merging means continually merge the environment data and/or the map data and/or the position data with a situation depiction that is already existent in the database to form an up-to-date situation depiction, and both the database and the situation depiction are in a fixed location. The inventive system therefore comprises all the means necessary for carrying out the inventive method and allows the up-to-date situation depiction to be produced easily in a manner that is detailed and essentially always up-to-date. This results in the advantages already described.

Preferably, the system is distinguished in that the database is arranged locally at a location that the situation depiction covers. This results in the advantage that the information can be transmitted via short-range communication means that transmit comparatively quickly. This uses exclusively local transmission capacity from the available transmission channels. A further advantage is that the local arrangement of the database means that it is not necessary to keep a complex data infrastructure for a central database.

In addition, it is advantageous that the ambient sensors and/or vehicle sensors are one or more elements from the group radar sensor,
optical camera sensor,
lidar sensor,
laser sensor,
ultrasonic sensor,
ESP sensor,
acceleration sensor,
ABS sensor and
inclination sensor and the vehicle-to-X communication means send and/or receive environment data and/or the map data and/or the position data on the basis of one or more connection classes from the group WLAN connection, particularly based on IEEE 802.11,
ISM (Industrial, Scientific, Medical band) connection,
Bluetooth® connection,
ZigBee connection
UWB (ultra wide band) connection,
WiMax® (Worldwide Interoperability for Microwave Access) connection,
infrared connection and
mobile radio connection.

Said sensors are forms of sensor that are typically used in the motor vehicle sector, which essentially allow comprehensive sensing and recognition of the vehicle environment and of the vehicle state. At the present time, a large number of vehicles are already equipped with multiple sensors of the stated types as standard, and this number will in all probability increase further in future. The additional equipment complexity for implementing the inventive method in a motor vehicle is therefore low. The listed connection classes of the vehicle-to-X communication means afford different advantages and disadvantages, depending on type and wavelength. By way of example, WLAN connections allow a high data transmission rate and fast connection setup. By contrast, ISM connections afford only a relatively low data transmission rate, but are outstandingly suited to data transmission around visual obstacles. Infrared connections in turn likewise afford a low data transmission rate. Finally, mobile radio connections are not impaired by visual obstacles and afford a good data transmission rate. In exchange, connection setup is comparatively slow, however. The combination and simultaneous or parallel use of a plurality of these connection types result in further advantages, since in this way the disadvantages of individual connection types can be compensated for.

Preferably, provision is made for the system to carry out the inventive method.

BRIEF DESCRIPTION OF THE DRAWINGS

Further preferred embodiments can be found in the subclaims and the descriptions below of exemplary embodiments with reference to figures, in which FIG. 1 schematically shows the creation of an up-to-date situation depiction in a database, FIG. 2 schematically shows the registration of objects in the up-to-date situation depiction and the provision of the objects with probabilities of existence

DETAILED DESCRIPTION OF THE PREFERRED EMBODIMENTS

Figure 1A:
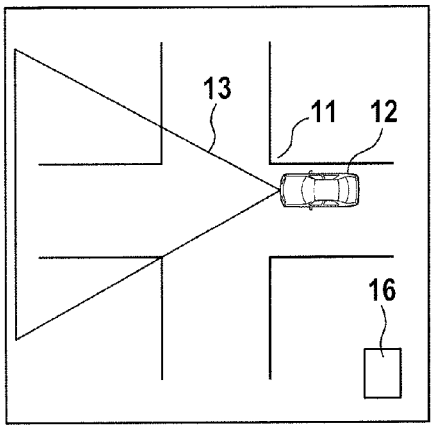
Figure 1B:
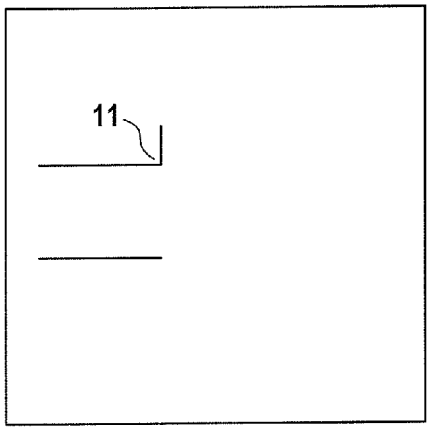
Figure 1C:
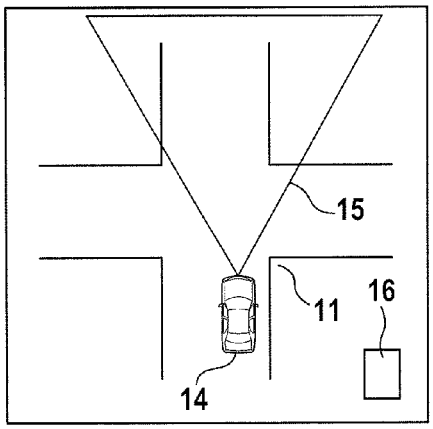
Figure 1D:
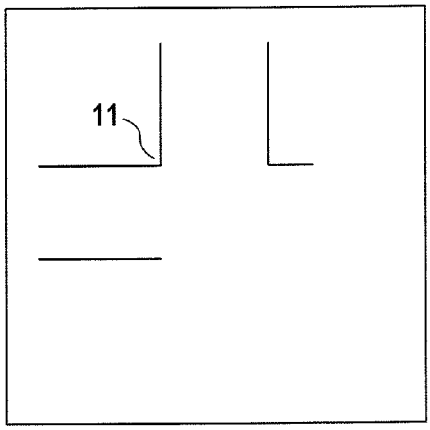

FIG. 1*a* schematically shows the junction 11, which vehicle 12 enters from the right. Vehicle 12 is equipped with a camera sensor that senses the conical region 13 of the junction 11. The environment data that the conical region 13 comprises are transmitted to the local database 16 by means of vehicle-to-X communication 408 using a WLAN connection. The local database 16 is arranged close to the junction 11 and then contains the information about the junction 11 that is shown in FIG. 1*b*. Shortly afterward, vehicle 14 enters the junction 11 from below (FIG. 1*c*). Vehicle 14 is likewise equipped with a camera sensor and uses the camera sensor to sense the conical region 15 of the junction 11. These environment data that the conical region 15 comprises are likewise sent via a WLAN connection to the local database 16, where they are merged with the already existent data. Hence, the database has the up-to-date situation depiction shown in FIG. 1*d* available. The position data from vehicles 12 and 14 are not included in the up-to-date situation depiction in the example.

Figure 2A:
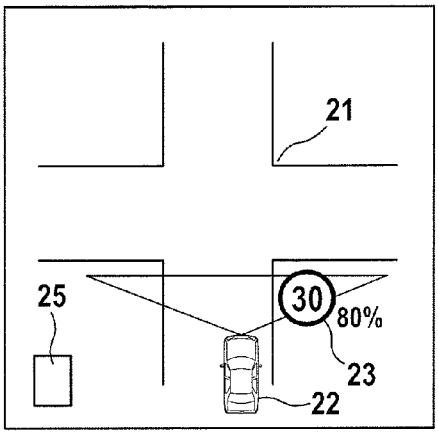
Figure 2B:
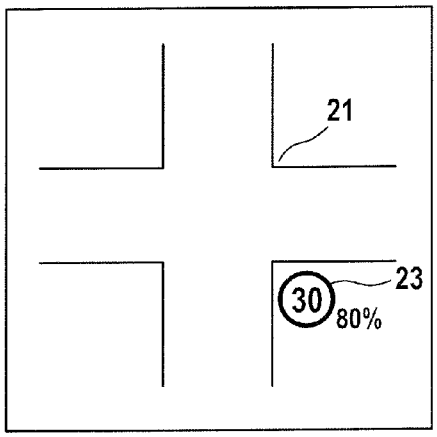
Figure 2C:
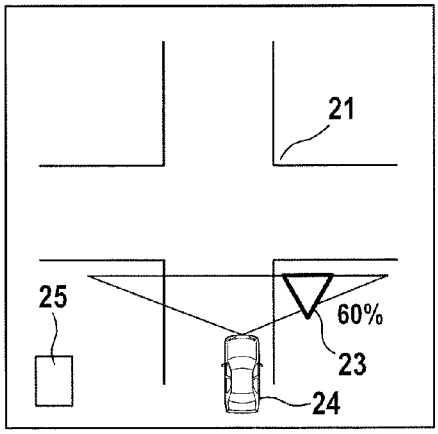
Figure 2D:
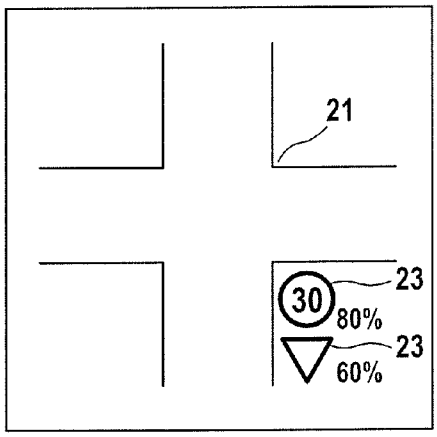

FIG. 2*a* shows the junction 21. Vehicle 22 enters the junction 21 and uses a camera sensor to recognize the road sign 23 arranged at the junction 21 as a "30" speed limit. The probability of existence of the road sign 23 with the "30" property is assumed to be 80% by vehicle 22 following an evaluation by CPU 400 using an object recognition algorithm. Both the environment data describing the road sign 23 and the assumed, associated probability of existence are sent to the local database 25 by means of vehicle-to-X communication 408 using an ISM connection and merged by CPU 410 in memory 412 of said database with the already existent data. The up-to-date situation depiction produced in this way can be seen in FIG. 2*b* and is sent to all further vehicles entering the junction. In FIG. 2*c*, vehicle 24 enters the junction 21 and likewise uses a camera sensor to sense the road sign 23. However, vehicle 24 recognizes the road sign 23 not as a "30" speed limit but rather as "Yield". An object recognition algorithm performed by CPU 400 on which the object recognition is based assumes the probability of existence of the road sign 23 with the "Yield" property to be 60%. These data are likewise sent by vehicle-to-X communication 408 of vehicle 24 to the local database 25, where they are merged by CPU 410 with the already existent situation depiction to form an up-to-date situation depiction (FIG. 2*d*). The up-to-date situation depiction therefore contains two inconsistent objects with different probabilities of existence at the position of the road sign 23. These data are sent by vehicle-to-X communication 414 of the local database to all further vehicles entering the junction 21 and are made available to corresponding driver assistance systems in the vehicles. The probabilities of existence that are likewise sent are used by the further vehicles in order to reduce a threshold value for an object recognition algorithm. Since the probability of existence that is existent in the local database for the road sign 23 with the "30" property is 80% and the probability of existence for the road sign 23 with the "Yield" property is just 60%, the threshold value for recognizing the road sign 23 with the "30" property is reduced to a correspondingly greater extent than for recognition with the "Yield" property.

Figure 3:
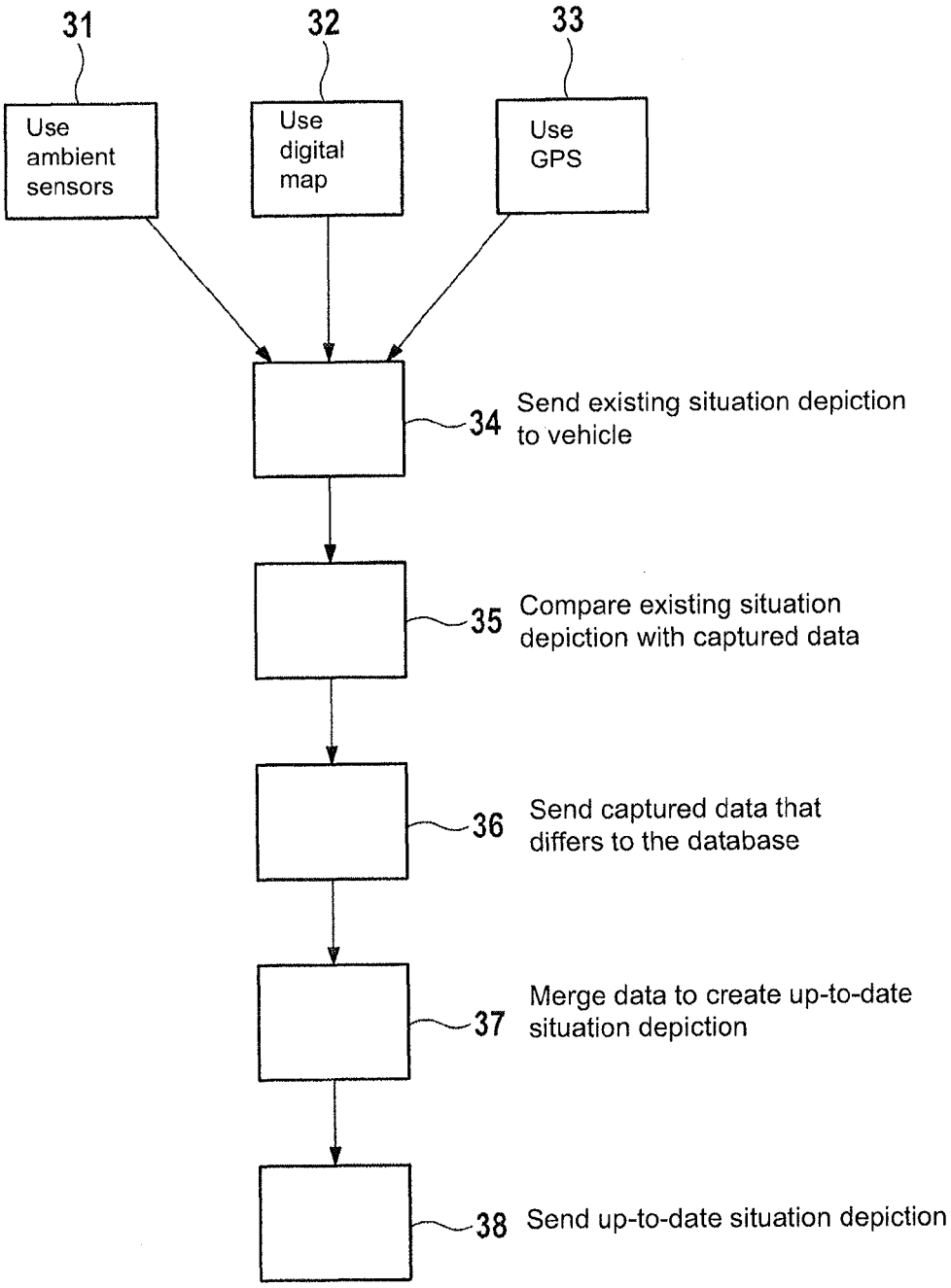
FIG. 3 shows an exemplary sequence for the inventive method in the form of a flowchart.
Figure 4:
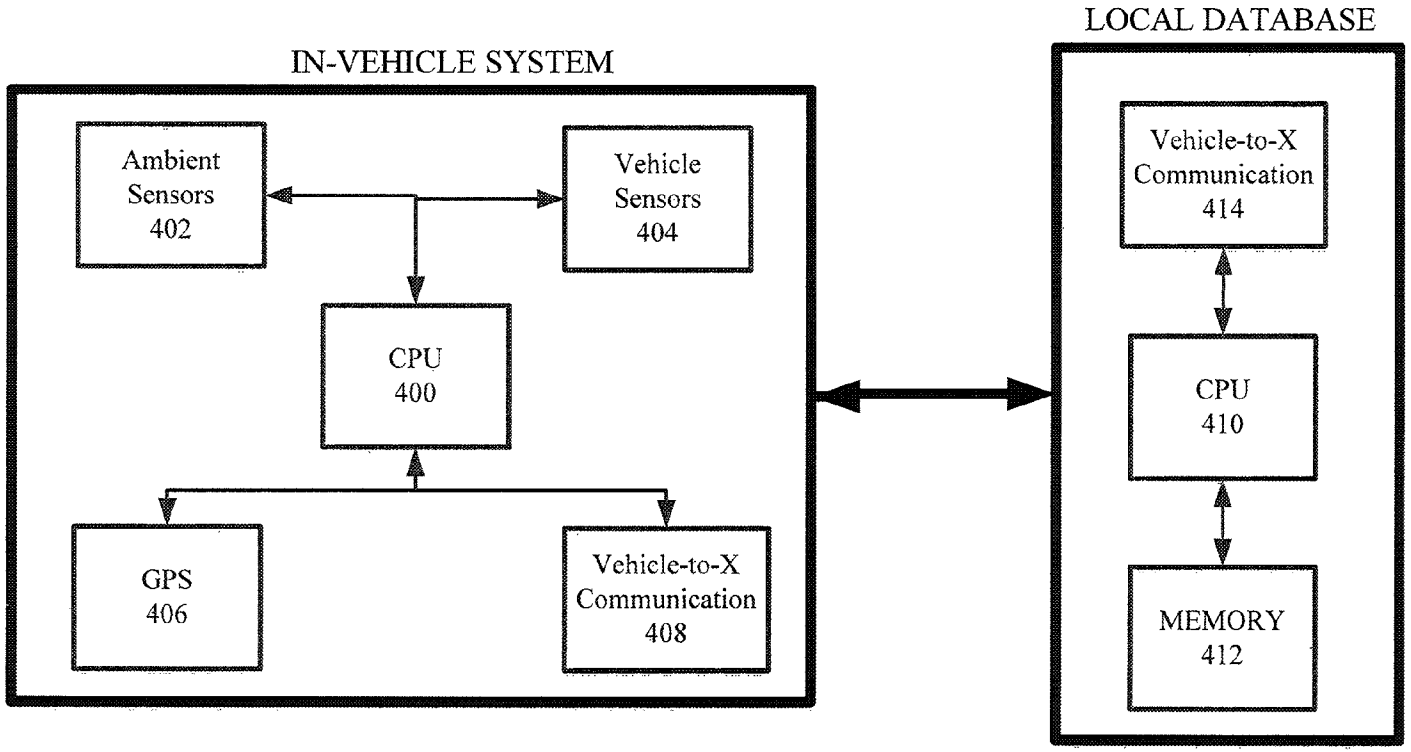
FIG. 4 shows a system including and in-vehicle system and a database.

FIG. 3 shows a flowchart with an exemplary sequence for the inventive method with respect to the system in FIG. 4. In the method steps 31, 32 and 33, a vehicle uses ambient sensors 402 and vehicle sensors 404, a digital map and a global satellite position system 406 to capture or read or determine environment data, map data and position data. In step 34, a situation depiction that is already existent in the database is sent to the vehicle, said situation depiction being compared in method step 35 with the data captured by the vehicle. In step 36, those data captured by the vehicle that differ from the situation depiction that is existent in the database are sent to the database by the vehicle-to-X communication 408 of the vehicle. The situation depiction that is already existent in the local database is merged by CPU 410 in method step 37 with the environment data, map data and position data sent by the vehicle to form an up-to-date situation depiction and, in step 38, is sent again by the vehicle-to-X communication 414 of the local database to all vehicles associated with the current situation.

The invention claimed is:

1. A method for producing an up-to-date situation depiction, the method comprising:

capturing environment data in a geographic area by at least one of ambient sensors and vehicle sensors of an in-vehicle system, generating, by a processor of the in-vehicle system, a probability associated with the environment data, and storing the probability in a digital memory of the in-vehicle system, reading, by the processor of the in-vehicle system, map data from the digital memory of the in-vehicle system, determining, by the processor of the in-vehicle system, a position of the vehicle by a global satellite position system of the in-vehicle system, wirelessly transmitting the environment data with the associated probability, by a vehicle-to-X communication device of the in-vehicle system to a stationary database arranged in proximity to the geographic area, comparing, by a processor of the stationary database, the environment data and associated probability with other environment data and other associated probability of the geographical area that is already existent in a memory of the stationary database, to determine when the environment data and the associated probability differ from the other environment data and the other associated probability that is already existent in a memory of the stationary database, continually merging, by the processor of the stationary database, environment data and the associated probability with the other environment data and the other associated probability when they differ, to form an up-to-date situation depiction of the geographic area, transmitting, by a vehicle-to-X communication device of the stationary database to the in-vehicle system, the up-to-date situation depiction of the geographic area, and controlling recognition, by the processor of the in-vehicle system, of the environment data based on the received probabilities.

2. The method as claimed in claim 1, wherein the database sends the up-to-date situation depiction to the vehicles covered by the locally bounded situation and the up-to-date situation depiction is made available to at least one driver assistance system by the vehicles.

3. The method as claimed in claim 1, wherein objects and events in the up-to-date situation depiction are provided with probabilities of existence by the database.

4. The method as claimed in claim 3, wherein the probabilities of existence of the objects are additionally individually evaluated by a receiving vehicle.

5. The method as claimed in claim 1, wherein at least one of the environment data, the map data and the position data are sent to the database by the multiplicity of vehicles with comparatively low transmission priority.

6. The method as claimed in claim 1, wherein the multiplicity of vehicles send to the database at least one of only such environment data, map data and position data as are different than the up-to-date situation depiction sent by the database.

7. The method as claimed in claim 1, wherein the position data sent by the multiplicity of vehicles comprise a piece of identification information for the satellites used for determining the position data.

8. A system for producing an up-to-date situation depiction, the system comprising:

a multiplicity of vehicles, each vehicle having at least one of a processor, a digital memory, ambient sensors, vehicle sensors, a global satellite positioning system and a vehicle-to-X communication device in an in-vehicle system, a stationary database of a stationary device arranged in proximity to a geographic area, that wirelessly receives at least one of an environment data, a map data and a position data wirelessly transmitted from the vehicle-to-X communication device of the in-vehicle system, wherein the multiplicity of vehicles capture the environment data in the geographic area by at least one of the ambient sensors and the vehicle sensors of the in-vehicle system, generate a probability associated with the environment data, transmit the environment data and the associated probability to the stationary database, and read the map data from the respective one digital memory of the in-vehicle system, and wherein the stationary database includes a processor configured to:

compare the environment data and associated probability with other environment data and other associated probability of the geographic area that is already existent in the stationary database, to determine when the environment data and the associated probability differ from the other environment data and the other associated probability that is already existent in the stationary database, continually merge the environment data and the associated probability with the other environment data and the other associated probability when they differ, to form an up-to-date situation depiction of the geographic area, transmit the up-to-date situation depiction of the geographic area to the in-vehicle system, and wherein the in-vehicle system controls recognition of environment data based on the received probabilities.

9. The system as claimed in claim 8, wherein the database is arranged locally at a location that the situation depiction covers.

10. The system as claimed in claim 8, wherein the ambient sensors are one or more elements selected from the group consisting of radar sensor, optical camera sensor, lidar sensor,
laser sensor,
ultrasonic sensor,
ESP sensor,
ABS sensor and
inclination sensor and the vehicle-to-X communication device at least one of send and receive at least one of environment data, the map data and the position data on the basis of one or more connection classes is selected from the group consisting of WLAN connection, particularly based on IEEE 802.11,
ISM (Industrial, Scientific, Medical band) connection,
Bluetooth® connection,
ZigBee connection
UWB (ultra wide band) connection,
WiMax® (Worldwide Interoperability for Microwave Access) connection,
infrared connection and
mobile radio connection.

11. The system as claimed in claim 8, wherein the system carries out a method in which at least one of environment data, map data and position data describing a locally bounded situation are sent to a database by a multiplicity of vehicles by vehicle-to-X communication device, wherein the environment data are captured by at least one of ambient sensors and vehicle sensors, wherein the map data are read from a digital memory and wherein the position data are determined at least by a global satellite position system, wherein at least one of the environment data, the map data and the position data are continually merged with a situation depiction that is already existent in the database to form an up-to-date situation depiction and both the database and the situation depiction are in a fixed location.

12. A method for producing an up-to-date situation depiction, the method comprising:

capturing environment data describing a geographic area by at least one of ambient sensors and vehicle sensors of an in-vehicle system, generating, by a processor of the in-vehicle system, a probability associated with the environment data, and storing the probability in a digital memory of the in-vehicle system, wirelessly transmitting, by the in-vehicle system, the environment data and an associated probability to a stationary database arranged in proximity to the geographic area;

comparing, by a processor of the stationary database, the environment data and associated probability with other environment data and other associated probability of the geographical area that is already existent in a memory of the stationary database, to determine when the environment data and the associated probability differ from the other environment data and the other associated probability that is already existent in a memory of the stationary database, continually merging, by the processor of the stationary database, environment data and the associated probability with the other environment data and the other associated probability when they differ to form an up-to-date situation depiction of the geographic area;

wherein the associated probabilities are probabilities of existence of objects and events in the environment data determined from a proportion of at least one of the ambient sensors and the vehicle sensors sensing the objects and events with respect to a proportion of at least one of the ambient sensors and the vehicle sensors not sensing the objects and events, wherein a number of at least one of the ambient sensors and the vehicle sensors not configured to sense the objects and events are ignored in determining the probabilities.

* * * * *